United States Patent [19]

Ikeda et al.

[11] Patent Number: 4,791,095

[45] Date of Patent: Dec. 13, 1988

[54] HEAT-SENSITIVE RECORDING MATERIAL

[75] Inventors: Kensuke Ikeda; Ken Iwakura, both of Shizuoka, Japan

[73] Assignee: Fuji Photo Film Co., Ltd., Kanagawa, Japan

[21] Appl. No.: 931,095

[22] Filed: Nov. 17, 1986

[30] Foreign Application Priority Data

Nov. 15, 1985 [JP] Japan ..... 60-256405
Nov. 15, 1985 [JP] Japan ..... 60-256406

[51] Int. Cl.[4] ..... B41M 5/18

[52] U.S. Cl. ..... 503/209; 427/150; 427/151; 428/913; 503/208; 503/216; 503/217; 503/225

[58] Field of Search ..... 346/208, 209, 216, 225; 427/150–152; 428/913; 503/208, 209, 216, 217, 225

[56] References Cited

U.S. PATENT DOCUMENTS 4,628,335 12/1986 Igarashi et al. ..... 346/209

FOREIGN PATENT DOCUMENTS 0187584 9/1985 Japan ..... 346/209

*Primary Examiner*—Bruce H. Hess
*Attorney, Agent, or Firm*—Sughrue, Mion, Zinn, Macpeak and Seas

[57] ABSTRACT

A heat-sensitive recording material comprising a support having provided thereon a heat-sensitive color-forming layer which contains a colorless or slightly colored electron-donating dye precursor and an electron-accepting compound capable of reacting with the electron-donating dye precursor to form color, wherein the heat-sensitive color-forming layer further contains at least one of the compounds represented by the general formulae (I) to (VI) shown in the specification and at least one of the compounds represented by the general formulae (VIII) to (XII) shown in the specification, or wherein the heat-sensitive color-forming layer further contains about 0.5 wt % to less than about 20 wt %, based on the electron-accepting compound, of the compound represented by the general formula (XIII) shown in the specification. The heat-sensitive recording material obtained provides a high density color image and does not undergo a decrease in heat responsibility and an increase in background fog formation.

8 Claims, No Drawings

HEAT-SENSITIVE RECORDING MATERIAL

FIELD OF THE INVENTION

This invention relates to a heat-sensitive recording material and, more particularly, to a heat-sensitive recording material utilizing the coloration reaction between a colorless or slightly colored electron-donating dye precursor and an electron-accepting compound.

BACKGROUND OF THE INVENTION

So-called two-component system heat-sensitive recording materials utilizing the coloration reaction between a colorless or slightly colored electron-donating dye precursor and an electron-accepting compound are disclosed, for example, in Japanese patent publication Nos. 14039/70 and 4160/68, etc.

These two-component system heat-sensitive recording materials comprise a support having coated thereon a colorless or slightly colored electron-donating dye precursor and an electron-accepting compound as fine particles in such manner that these two types of thermally reactive compounds are separated from each other by a binder or the like, one or both of the compounds becomes molten upon heating the materials, and thus, contact between the compounds occurs to cause a coloration reaction.

Such two-component system heat-sensitive recording materials have the advantages that: (1) they utilize a primary coloration reaction and, therefore, do not require development; (2) they possess paper quality which approximates that of ordinary paper; (3) they can be handled with ease; (4) they provide high density coloration; and (5) heat-sensitive recording materials providing various color hues can be easily prepared. Thus, these materials have tremendous advantages and, hence, are most often utilized as heat-sensitive recording materials.

In recent years, this type of heat-sensitive recording materials have been particularly utilized in the field of facsimiles, recorders, and printers. With recent increasing usage in the field of information transmission via facsimiles, recording speed has been concomitantly increased. As to heat-sensitive recording materials, color-forming properties inherent in such materials which are capable of forming color with sufficient density by a short pulse width, or a low heat energy (i.e., an improved heat responsibility) have been strongly desired, and various attempts along these lines have been made, as disclosed, for example, in Japanese patent application (OPI) Nos. 187393/83, 67083/84, 54884/85, etc. (the term "OPI" as used herein refers to a published unexamined Japanese patent application"). However, increased heat responsibility tends to increase fog density in the white background portion of the recording materials; thus, commercial value of these recording materials is often undesirably lowered. Therefore, various attempts have been made, such as disclosed in Japanese patent application (OPI) Nos. 169889/84, 205796/83, 167297/84, etc., to solve this problem of fog density in the white background portion. However, all of these attempts have the specific defect in that fog in the white background area is not sufficiently prevented, or that heat responsibility is seriously reduced when fog formation is prevented to some extent.

SUMMARY OF THE INVENTION

An object of the present invention is to provide a heat-sensitive recording material which provides a high density color image even when a low heat energy is applied thereto, and which does not undergo a decrease in heat responsibility and an increase in background fog formation even when stored under conditions of high temperature and high humidity or is stored for a long time.

The above-described object of the present invention can be attained by a heat-sensitive recording material comprising a support having coated thereon a heat-sensitive color-forming layer which contains a colorless or slightly colored electron-donating dye precursor and an electron-accepting compound capable of reacting with the electron-donating dye precursor to form color, wherein the heat-sensitive color-forming layer contains 1) at least one of the compounds represented by the following general formulae (I) to (VI), and 2) at least one of the compounds represented by the general formulae (VII) to (XII) shown below.

The above-described objects can also be attained by another embodiment of the present invention, namely, a heat-sensitive recording material having a heat-sensitive color-forming layer which contains a colorless or slightly colored electron-donating dye precursor and an electron-accepting compound capable of reacting with the electron-donating dye precursor to form color, wherein the heat-sensitive color-forming layer contains about 0.5 wt% to less than about 20 wt%, based on the electron-accepting compound, of a compound represented by the following general formula (XIII).

Some of the above-mentioned compounds in accordance with the present invention, i.e., those represented by the general formulae (I) to (VI), are disclosed in Japanese patent application (OPI) Nos. 11390/85 and 219086/85. However, these disclosed thermal coloring techniques are still insufficient for obtaining good preservability of printed images and for preventing reduction in heat responsibility of heat-sensitive recording materials stored at high temperatures or under conditions of high humidity. Thus, the commercial value of these recording materials is seriously reduced. These defects can be removed by incorporating at least one of the compounds represented by the formulae (VIII) to (XII), shown below, together with at least one of the compounds represented by the following general formulae (I) to (VI) or by separately incorporating about 0.5 wt% to less than about 20 wt%, based on the electron-accepting compound, of a compound represented by the following general formula (XIII). In addition, background fog can be remarkably decreased in comparison with the case of adding only one, or none, of the compounds of the formulae (I) to (VI) or (VIII) to (XII) (or omitting compounds of the formula (XIII) in the other embodiment) to the heat-sensitive color-forming layer in accordance with the present invention.

DETAILED DESCRIPTION OF THE INVENTION

These compounds comprising the color-forming layer in various aspects of the present invention will now be described in detail. The first group comprises compounds represented by the following general formulae (I) to (VI):

(I)

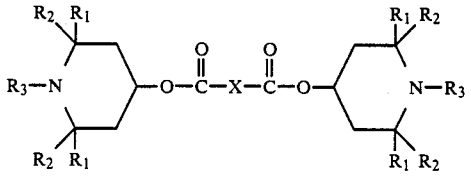

(II)

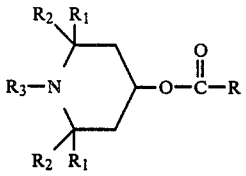

(III)

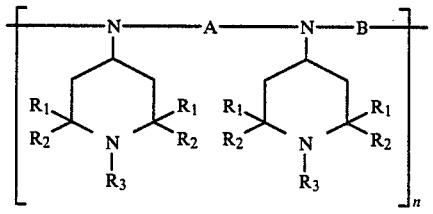

(IV)

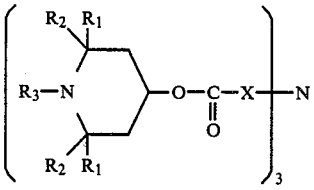

(V)

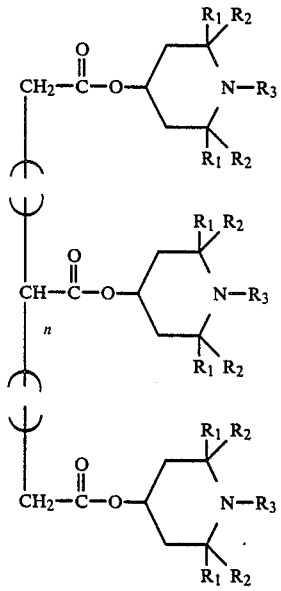

(VI)

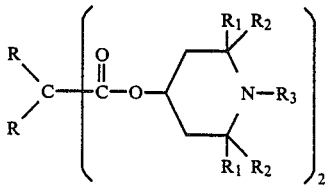

wherein $R_1$ and $R_2$ each may represent a hydrogen atom or an alkyl group, preferably a hydrogen atom or an alkyl group containing 1 to 4 carbon atoms, $R_3$ represents a hydrogen atom, an alkyl group, or an acyl group, preferably a hydrogen atom or an acyl group containing 1 to 10 carbon atoms.

In the general formulae (I) and (IV), X represents an alkylene group containing 1 to 18 carbon atoms.

In the general formulae (II) and (VI), R represents an alkyl group containing 1 to 18 carbon atoms, an aryl group containing 6 to 12 carbon atoms or an aralkyl group containing 7 to 12 carbon atoms, which may optionally be partly substituted by an alkyl group or a hydroxy group, preferably a 3,5-di-t-butyl-4-hydroxyphenyl group.

In the general formula (III), A and B each may represent an alkylene group containing 1 to 12 carbon atoms, an alkenylene group containing 2 to 12 carbon atoms or an alkynylene group containing 2 to 12 carbon atoms.

In the general formulae (III) and (V), n represents an integer of up to 12.

The first group of compounds described above in accordance with the present invention represented by the general formulae (I) to (VI) are preferably used in an amount of about 0.5 wt% to less than about 40 wt% based on the electron-accepting compound capable of reacting with the electron-donating dye precursor to form color.

When the compounds in accordance with the present invention represented by the general formulae (I) to (VI) are present in an amount of less than about 0.5 wt% based on the electron-accepting compound, the effect of preventing background fog cannot be obtained, and increased background fog formation of a heat-sensitive recording material results. On the other hand, when used in an amount of about 40 wt% or more, the compounds cause serious deterioration of heat responsibility after being stored for a long time or under the conditions of high temperature and high humidity. Thus, in both cases, the commercial value of such heat-sensitive recording materials is significantly reduced, and this object of the present invention cannot be attained.

Compounds of the second group are represented by the general formulae (VII) to (XII), of which formulae (VII) to (XI) are shown below:

(VII)

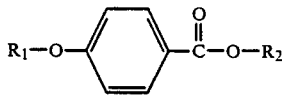

(VIII)

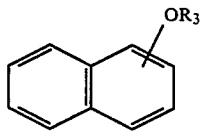

(IX)

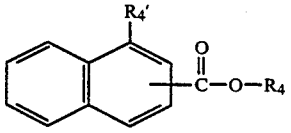

$R_5NHCONH_2$ (X)

$R_6CONH—R_7$ (XI)

wherein $R_1$ to $R_4$ each may preferably represent a phenyl group, a benzyl group, or a lower alkyl- or halogen-substituted group thereof, $R_5$ and $R_6$ each may represent an alkyl group containing 12 to 24 carbon atoms, and $R_7$ represents a hydrogen atom or a phenyl group.

Where the phenyl or benzyl group represented by $R_1$ to $R_4$ in the general formulae (VII) to (XI) is substituted by a lower alkyl group, the alkyl substituent contains 1 to 8, preferably 1 to 3, carbon atoms and, where substituted by a halogen atom, the halogen substituent is preferably a fluorine atom. In the formula (IX), $R_4'$ represents a hydrogen atom or a hydroxy group.

Other compounds in this second group are represented by the general formula (XII):

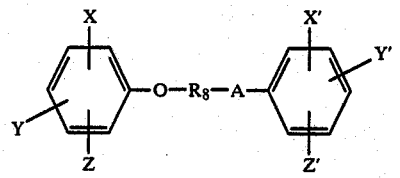

(XII)

wherein $R_8$ represents a divalent group, preferably an alkylene group, an alkylene group having a carbonyl group, an alkylene group having a halogen atom, or an alkylene group having an unsaturated bond, and more preferably represents an alkylene group or an ether bond-containing alkylene group; X, Y, Z, X', Y' and Z', which each may be the same or different, each may represent a hydrogen atom, a halogen atom, an alkyloxycarbonyl group or an aralkyloxycarbonyl group, and A represents O or S.

This group of compounds of the foregoing general formulae (VII) to (XII) preferably have a melting point of about 70° C. to about 150° C., more preferably 80° C. to 130° C. Specific examples thereof include benzyl p-benzyloxybenzoate (m.p. 119° C.), β-naphthyl benzyl ether (m.p. 105° C.), stearic acid amide (m.p. 108° C.), palmitic acid amide (m.p. 103° C.), N-phenyl stearic acid amide (m.p. 96° C.), N-stearylurea (m.p. 110° C.), phenyl β-naphthoate (m.p. 92° C.), phenyl 1-hydroxy-2-naphthoate (m.p. 92° C.), β-naphthol (p-chlorobenzyl) ether (m.p. 115° C.), β-naphthol (p-methylbenzyl) ether (m.p. 96° C.), α-naphthyl benzyl ether (m.p. 76° C.), 1,4-butanediol p-methylphenyl ether (m.p. 93° C.), 1,4-propanediol p-methylphenyl ether (m.p. 93° C.), 1,4-butanediol p-isopropylphenyl ether (m.p. 79° C.), 1,4-butanediol p-t-octylphenyl ether (m.p. 99° C.), 2-phenoxy-1-p-tolyloxyethane (m.p. 104° C.), 1-phenoxy-2-(4-ethylphenoxy)ethane (m.p. 106° C.), 1-phenoxy-2-(4-chlorophenoxy)ethane (m.p. 77° C.), 1,4-butanediol phenyl ether (m.p. 98° C.), diethylene glycol bis(4-methoxyphenyl)ether (m.p. 101° C.), etc.

These compounds of the general formulae (VII) to (XII) may be used singly or as a mixture thereof and, for obtaining the effects of the present invention, they are preferably used in an amount of about 10 to about 200 wt%, more preferably 20 to 150 wt%, based on the electron-accepting compound.

Another embodiment of the present invention comprises incorporating compounds represented by the general formula (XIII), shown below, to the heat-sensitive color-forming layer containing a colorless or slightly colored electron-donating dye precursor and an electron-accepting compound capable of reacting with each other to form color. These compounds of the general formula (XIII) are as follows:

(XIII)

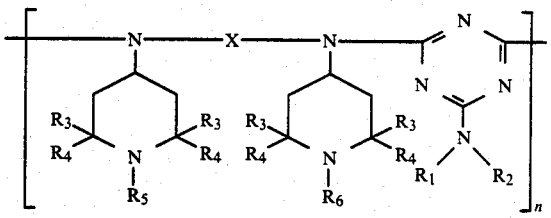

wherein $R_1$ and $R_2$ each may preferably represent a hydrogen atom, an alkyl group containing 1 to 18 carbon atoms, or an aryl group. Specific examples of $R_1$ and $R_2$ include a methyl group, an ethyl group, a propyl group, an isopropyl group, a butyl group, a t-butyl group, a hexyl group, an octyl group, a benzyl group, a phenethyl group, a cetyl group, a stearyl group, an α-methylbenzyl group, an α-methylchlorobenzyl group, etc. Particularly preferred examples thereof are alkyl groups which are branched at an α-position, such as a t-butyl group, a t-amyl group, a t-hexyl group, a t-octyl group, a t-dodecyl group, etc.

In addition, $R_1$ and $R_2$ may combine together to form a 5- to 7-membered ring optionally containing a hetero atom or atoms, such as a pyrrolidine ring, a piperidine ring, a morpholine ring, an isoquinoline ring, an isoindole ring, a benzazepine ring, an azepine ring, a phenothiazine ring, an N-methylpiperazine ring, etc.

X represents an alkylene group, an aralkylene group, an alkenylene group, or an arylene group, with a divalent group containing up to 8 carbon atoms being preferred. $R_3$ and $R_4$ each may preferably represent a hydrogen atom or an alkyl group containing 1 to 4 carbon atoms, with a methyl group or an ethyl group being preferred.

$R_5$ preferably represents a hydrogen atom, an alkyl group containing 1 to 10 carbon atoms, or an acyl group. n preferably represents an integer of up to 10, particularly preferably up to 8.

The compounds of the general formula (XIII) in accordance with the present invention are preferably used in an amount of about 0.5 wt% to less than about 20 wt% based on the electron-accepting compound capable of reacting with the electron-donating dye precursor to form color. When compounds in accordance with the general formula (XIII) are present in the color-forming layer in an amount of less than about 0.5 wt% based on the electron-accepting compound, the effect of preventing background fog cannot be obtained, and increased background fog formation of the heat-sensitive recording material occurs. On the other hand, when used in an amount of about 20 wt% or more, these compounds cause serious deterioration of heat sensitivity after being stored for a long time or stored under conditions of high temperature and high humidity. Thus, in both cases, the commercial value of such heat-sensitive recording materials is seriously reduced, and the above-noted objects of the present invention cannot be attained. A particularly preferred amount of the compounds of the general formula (XIII) ranges from 1 wt% to less than 18 wt% based on the electron-accepting compound.

It should be clear from the above description that this second embodiment of the heat-sensitive materials of the present invention, i.e., the embodiment incorporating compounds of the general formula (XIII), exists in the absence of compounds of the general formulae (I) to (VI) and (VII) to (XII), and is able to achieve the above-noted objects in accordance with the description herein. However, in a preferred aspect of this embodiment, compounds of the general formulae (VII) to (XII) described above can be co-present in the heat-sensitive color-forming layer with the compounds of the general formula (XIII) in order to improve the heat responsibility of the recording materials, if desired. If present, these compounds of the general formulae (VII) to (XII) may be used alone or in combination, and are preferably used in an amount of about 10 wt% to about 200 wt%, more preferably 20 wt% to 150 wt%, based on the electron-accepting compound.

The other components of the heat-sensitive recording materials of the present invention are described hereinbelow, and may be present in both embodiments of the present invention described above.

Examples of the colorless or slightly colored electron-donating dye precursor include triarylmethane compounds, diphenylmethane compounds, xanthene compounds, thiazine compounds, spiropyran compounds, etc. Specific examples thereof are described in, for example, Japanese patent application (OPI) No. 27253/80, etc.

These compounds are partly exemplified below. The triarylmethane compounds include 3,3-bis(p-dimethylaminophenyl)-6-dimethylaminophthalide (or Crystal Violet lactone), 3,3-bis(p-dimethylaminophenyl)phthalide, 3-(p-dimethylaminophenyl)-3-(1,3-dimethylindol-3-yl)phthalide, 3-(p-dimethylaminophenyl)-3-(2-methylindol-3-yl)phthalide, etc.; the diphenylmethane compounds include 4,4'-bis(dimethylaminobenzhydrin benzyl ether, N-halophenylleucoauramine, N-2,4,5-trichlorophenylleucoauramine, etc.; the xanthene compounds include Rhodamine B anilinolactam, Rhodamine (p-nitrino)lactam, 2-(dibenzylamino)fluoran, 2-phenylamino-6-diethylaminofluoran, 2-(o-chloroanilino)-6-diethylaminofluoran, 2-(3;4-dichloroanilino)-6-diethylaminofluoran, 2-anilino-3-methyl-6-piperidinofluoran, 2-phenyl-6-diethylaminofluoran, etc.; the thiazine compounds include benzoleucomethylene blue, p-nitrobenzylleucomethylene blue, etc.; and the spiropyran compounds include 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)-spiropyran, 3-propyl-spiro-dibenzopyran, etc. These compounds may be used alone or in combination.

Of these, electron-donating dye precursors of the triarylmethane compounds (e.g., Crystal Violet lactone) and the xanthene compounds are preferred, since many of these cause less fog and provide high coloration density. More preferred compounds include xanthene compounds represented by the following general formula (XIV):

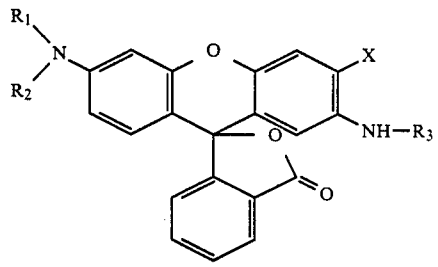

(XIV)

wherein $R_1$ and $R_2$ each may preferably represent a straight or branched chain alkyl group containing 1 to 10 carbon atoms, or may combine to form a substituted or unsubstituted ring. Further, $R_1$ and $R_2$ may form a 5- to 7-membered ring containing a hetero atom or atoms.

$R_3$ represents an aryl group, preferably an aryl group containing 6 to 20 carbon atoms, and particularly preferably a phenyl group or a substituted phenyl group. As the substituent for the phenyl group, an alkyl group containing 1 to 10 carbon atoms is preferred.

X preferably represents an alkyl group containing 1 to 10 carbon atoms or a halogen atom.

Examples of these colorless or slightly colored electron-donating dye precursors are illustrated below; these specific examples, however, are not intended to limit the scope of the present invention in any manner: 2-anilino-3-methyl-6-dimethylaminofluoran, 2-anilino-3-methyl-6-N-methyl-N-ethylaminofluoran, 2-anilino-3-methyl-6-N-methyl-N-(isopropyl)aminofluoran, 2-anilino-3-methyl-6-N-methyl-N-pentylaminofluoran, 2-anilino-3-methyl-6-N-methyl-N-cyclohexylaminofluoran, 2-anilino-3-methyl-6-diethylaminofluoran, 2-anilino-3-chloro-6-dimethylaminofluoran, 2-anilino-3-methyl-6-N-ethyl-N-isoamylaminofluoran, 2-anilino-3-methyl-6-N-methyl-N-isoamylaminofluoran, 2-anilino-3-chloro-6-diethylaminofluoran, 2-anilino-3-chloro-6-N-methyl-N-ethylaminofluoran, 2-anilino-3-chloro-6-N-methyl-N-(isopropyl)aminofluoran, 2-anilino-3-chloro-6-N-methyl-N-pentyl aminofluoran, 2-anilino-3-chloro-6-N-methyl-N-cyclohexyl-aminofluoran, 2-anilino-3-methyl-6-N-ethyl-N-pentylaminofluoran, 2-anilino-3-chloro-6-N-ethyl-N-pentylaminofluoran, 2-(p-methylanilino)-3-methyl-6-dimethylaminofluoran, 2-(p-methylanilino)-3-methyl-6-diethylaminofluoran, 2-(p-methylanilino)-3-methyl-6-N-methyl-N-ethylaminofluoran, 2-(p-methylanilino)-3-methyl-6-N-methyl-N-(isopropyl)aminofluoran, 2-(p-methylanilino)-3-methyl-6-N-methyl-N-pentylaminofluoran, 2-(p-methylanilino)-3-methyl-6-N-methyl-N-cyclohexylaminofluoran, 2-(p-methylanilino)-3-methyl-6-N-ethyl-N-pentylaminofluoran, 2-(p-methylanilino)-3-chloro-6-dimethylaminofluoran, 2-(p-methylanilino)-3-chloro-6-diethylaminofluoran, 2-(p-methylanilino)-3-chloro-6-N-methyl-N-ethylaminofluoran, 2-(p-methylanilino)-3-chloro-6-N-methyl-N-(isopropyl)aminofluoran, 2-(p-methylanilino)-3-chloro-6-N-methyl-N-cyclohexylaminofluoran, 2-(p-methylanilino)-3-chloro-6-N-methyl-N-pentylaminofluoran, 2-(p-methylanilino)-3-chloro-6-N-ethyl-N-pentylaminofluoran, 2-anilino-3-methyl-6-N-methyl-N-furylmethylaminofluoran, 2-anilino-3-ethyl-6-N-methyl-N-furylmethylaminofluoran, etc. These compounds may be used alone or, for adjusting color tone or preventing color image from fading, two or more may be used in combination.

The electron-donating dye precursors of the present invention are preferably used in an amount of about 0.1 to 1.5 g/m$^2$.

The electron-accepting compounds to be used in the present invention include the compounds which are illustrated in Japanese Patent Application (OPI) Nos. 187393/83, 67083/84, etc. Preferred examples thereof include those compounds represented by the following general formulae (XV) to (XIX):

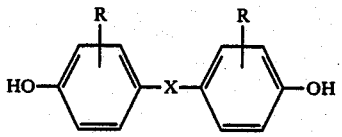

(XV)

wherein X represents S, O, $SO_2$, $S_2$ or

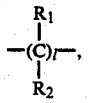

l represents an integer of 1 to 3, $R_1$ and $R_2$ each may represent a hydrogen atom or an alkyl group containing 1 to 8 carbon atoms or $R_1$ and $R_2$ may combine to form a cycloalkyl group, or $R_2$ may represent an ester group represented by —COOR', wherein R' represents an alkyl group containing 1 to 10 carbon atoms, and R represents a straight or branched chain alkyl group containing 1 to 8 carbon atoms or a halogen atom;

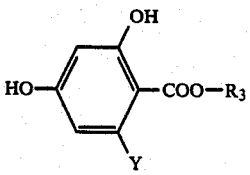

(XVI)

wherein Y represents a hydrogen atom, —$CH_3$ or —OH, and $R_3$ represents

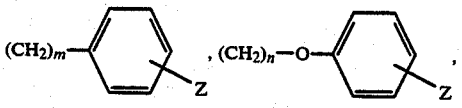

or a straight or branched chain alkyl group containing 1 to 6 carbon atoms, m and n each represents an integer of 1 to 3, wherein Z represents a hydrogen atom, a halogen atom or —$CH_3$;

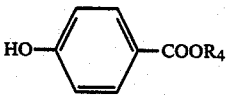

(XVII)

wherein $R_4$ represents a benzyl group, a halogen atom or a straight or branched chain alkyl group containing 1 to 8 carbon atoms;

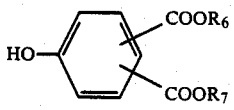

(XVIII)

wherein $R_6$ and $R_7$ each may represent an alkyl group containing 1 to 8 carbon atoms; and

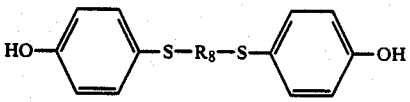

(XIX)

wherein $R_8$ represents an alkylene group containing 1 to 5 ether bonds.

Specific examples of the compounds represented by the above general formulae (XV) to (XVIII) are illustrated below: 2,2-bis(4'-hydroxyphenyl)propane, 2,2-bis(4'-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'-hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)-2-methylpentane, 1,1-bis(4'-hydroxyphenyl)-2-ethylhexane, 1,1-bis(4'-hydroxyphenyl)dodecane, 3,3-bis(4'-hydroxyphenyl)-pentane, 1,2-bis(4'-hydroxyphenyl)ethane, 1,1-bis(4'-hydroxypheny)sulfide, 1,1-bis(4'-hydroxyphenyl)sulfone, 1,1-bis(4'-hydroxyphenyl)ether, 2,2-bis(4'-hydroxy-3',5'-dichlorophenyl)butane, phenyl 2,4-dihydroxybenzoate, phenyl 2,4-dihydroxy-4'-methylbenzoate, phenyl 2,4-dihydroxy-4'-chlorobenzoate, phenyl 2,4-dihydroxy-6-methylbenzoate, phenyl 2,4,6-trihydroxybenzoate, phenyl 2,4-dihydroxy-6,4'-dimethylbenzoate, phenyl 2,4-dihydroxy-6-methyl-4'-chlorobenzoate, benzyl 2,4-dihydroxybenzoate, benzyl 2,4-dihydroxy-4'-methylbenzoate, benzyl 2,4-dihydroxy-4'-chlorobenzoate, benzyl 2,4-dihydroxy-6-methylbenzoate, benzyl 2,4,6-trihydroxybenzoate, benzyl 2,4-dihydroxy-6,4'-dimethylbenzoate, benzyl 2,4-dihydroxy-6-methyl-4'-chlorobenzoate, ethyl 4-hydroxybenzoate, propyl 4-hydroxybenzoate, isopropyl 4-hydroxybenzoate, benzyl 4-hydroxybenzoate, 2-ethylhexyl 4-hydroxybenzoate, benzyl 4-hydroxy-4'-chlorobenzoate, benzyl 4-hydroxy-4'-methylbenzoate, benzyl 4-hydroxy-4'-ethylbenzoate, dimethyl 3-hydroxy-m-phthalate, diethyl 3-hydroxy-m-phthalate, methyl 3-hydroxy-m-phthalate, dibutyl 3-hydroxy-m-phthalate, dimethyl 3-hydroxy-o-phthalate, diethyl 3-hydroxy-o-phthalate, methyl bis(4-hydroxyphenyl)acetate, isobutyl bis(4-hydroxyphenyl)acetate, etc.

Specific examples of the compounds of the general formula (XIX are as follows.

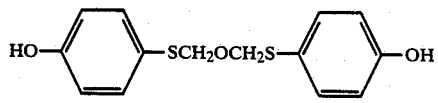

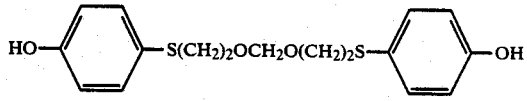

-continued

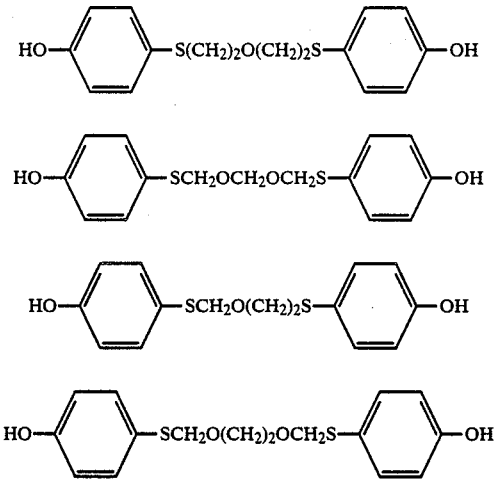

Preferred examples other than the electron-accepting compounds represented by the above general formulae (XV) to (XIX) include bishydroxycumylbenzenes or bishydroxy-α-methylbenzylbenzenes (specifically, 1,4-bis-p-hydroxycumylbenzene, 1,4-bis-m-hydroxycumylbenzene, 1,3-bis-p-hydroxycumylbenzene, 1,3-m-hydroxycumylbenzene, 1,4-bis-o-hydroxycumylbenzene, 1,4-bis-p-hydroxy-α-methylbenzylbenzene, 1,3-bis-p-hydroxy-α-methylbenzylbenzene, etc.), salicyclic acid derivatives (e.g., 3,5-di-α-methylbenzylsalicyclic acid, 3,5-di-t-butylsalicyclic acid, 3-α,α-dimethylbenzylsalicyclic acid, 4-n-pentadecylsalicyclic acid, etc.) or the polyvalent metal salts thereof (particularly preferably zinc salts and aluminum salts), and phenol derivatives (e.g., p-phenylphenol, 3,5-diphenylphenol, cumylphenol, etc.), though these are not limitative of electron-accepting compounds contemplated for use in accordance with the present invention at all.

The above-described electron accepting compounds are preferably used in an amount of about 50 to about 800 wt%, more preferably 100 to 500 wt%, based on the electron-donating dye precursor, and may be used alone or as a combination of two or more. The preferred amount of the electron-accepting compounds applied in the present invention is about 0.1 to 3.0 g/m$^2$.

A water-soluble binder is added to a recording layer of the heat-sensitive recording material of the present invention. Suitable binders include those compounds which dissolve in 25° C. water in an amount of about 5 wt% or more. Specific examples of binders are polyvinyl alcohol, methyl cellulose, carboxymethyl cellulose, hydroxyethyl cellulose, starches (including modified starches), gelatin, gum arabic, casein, styrene-maleic anhydride copolymer hydrolyzate, ethylene-maleic anhydride copolymer hydrolyzate, isobutylene-maleic anhydride copolymer hydrolyzate, carboxy-modified polyvinyl alcohol, polyacrylamide, a saponification product of vinyl acetate-polyacrylic acid copolymer, etc. These binders may also be used as dispersing agents for finely dispersing the electron-donating dye precursor, the electron-accepting compound, the heat-fusible compound, and the compounds which are added to the heat-sensitive color-forming layer in accordance with the present invention.

If necessary, a pigment, a water-insoluble binder, a metallic soap, a wax, a surfactant, etc., may be added to the recording layer of the heat-sensitive recording material of the present invention.

Suitable pigments include zinc oxide, calcium carbonate, barium sulfonate, titanium oxide, lithopone, talc, agalmatolite, kaolin, aluminum hydroxide, silica, amorphous silica, etc., with light calcium carbonate, kaolin, surface-treated amorphous silica, and aluminum hydroxide being preferred.

As the water-insoluble binder, synthetic rubber latexes or synthetic resin emulsions are common, and a styrene-butadiene rubber latex, an acrylonitrile-butadiene rubber latex, a methyl acrylate-butadiene rubber, latex, or a vinyl acetate emulsion, etc., may be used. For the purpose of preventing the heat-sensitive recording material from fogging, the amount of a surfactant in the rubber latex or emulsion should preferably be minimized, and so-called soap-free rubber latexes or emulsions are preferred.

Examples of the metallic soap encompass metal salts of higher fatty acids. More specifically, emulsions of zinc stearate, calcium stearate, aluminum stearate, etc., are used.

As the above-mentioned wax, emulsions of paraffin wax, microcrystalline wax, carnauba wax, methylolstearoamide, polyethylene wax, polystyrene wax, etc., can be employed.

As the surfactant, alkali metal salts of sulfosuccinic acid, fluorine-containing surfactants, etc., may be used.

In the heat-sensitive recording material of the present invention, compounds which prevent disappearance of printed color images may be incorporated in the heat-sensitive color-forming layer for preventing color disappearance and making formed images fast.

Such color disappearance-preventing agents include phenol derivatives, and particularly hindered phenol compounds are effective for this purpose. Preferred examples of the color disappearance-preventing agents include those compounds which are represented by the following general formulae (XX) to (XXIII):

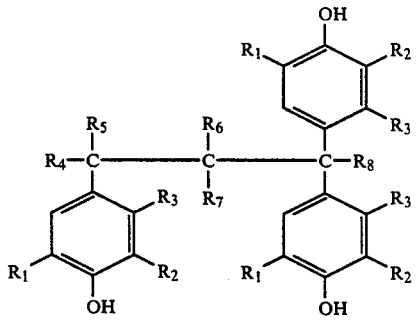

(XX)

wherein $R_1$ represents a branched chain alkyl group containing 3 to 8 carbon atoms; $R_2$ represents a hydrogen atom or a branched chain alkyl group containing 3 to 8 carbon atoms; $R_3$ represents a hydrogen atom or an alkyl group containing 1 to 3 carbon atoms; $R_4$ represents a hydrogen atom or an alkyl group containing 1 to 8 carbon atoms; $R_5$, $R_6$, and $R_7$ each may represent a hydrogen atom or an alkyl group containing 1 to 3 carbon atoms; and $R_8$ represents a hydrogen atom or an alkyl group containing 1 to 8 carbon atoms;

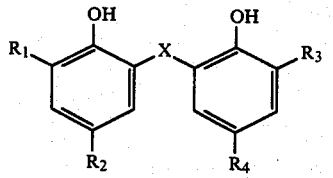

(XXI)

wherein $R_1$ and $R_3$ each may represent a branched chain alkyl group containing 3 to 8 carbon atoms; $R_2$ and $R_4$ each may represent an alkyl group containing 1 to 8 carbon atoms; X represents S, O, $SO_2$, $S_2$,

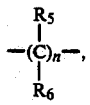

a cyclopentylene group or a cyclohexylene group, wherein n represents an integer of 1 to 3; and $R_5$ and $R_6$ each may represent a hydrogen atom or an alkyl group containing 1 to 8 carbon atoms;

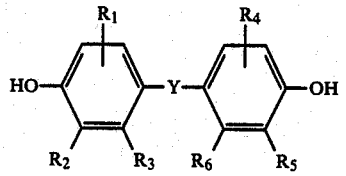

(XXII)

wherein $R_1$ and $R_4$ each may represent a branched chain alkyl group containing 3 to 8 carbon atoms; $R_2$, $R_3$, $R_5$ and $R_6$ each may represent a hydrogen atom or an alkyl group containing 1 to 8 carbon atoms; Y represents S, O, $SO_2$, $S_2$ or

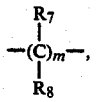

wherein m represents an integer of 1 to 3; and $R_7$ and $R_8$ each may represent a hydrogen atm or an alkyl group containing 1 to 8 carbon atoms or $R_7$ and $R_8$ may combine to form a cyclic pentamethylene group;

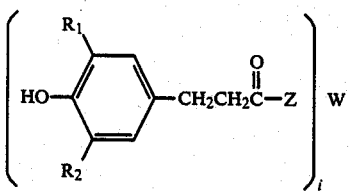

(XXIII)

wherein $R_1$ and $R_2$ each may represent a branched chain alkyl group containing 3 to 8 carbon atoms; Z represents —NH— or —$O(CH_2)_n$—, wherein n represents an integer of 1 to 5; i represents an integer of 1 to 4, provided that, when i=1, W represents an alkyl group containing 1 to 18 carbon atoms, when i=2, W represents S, O, or

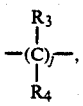

wherein $R_3$ and $R_4$ each may represent a hydrogen atom or an alkyl group containing 1 to 8 carbon atoms, and j represents an integer of 1 to 8, when i=3, W represents

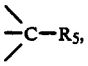

wherein $R_5$ represents a hydrogen atom or an alkyl group containing 1 to 8 carbon atoms, and, when i=4, W represents

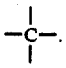

Typical examples of the phenol derivatives represented by the above general formulae (XX) to (XXIII) are illustrated below:

(A) Phenol derivatives represented by the general formula (XX) include 1,1,3-tris(2-methyl-4-hydroxy-5-tert-butylphenyl)butane, 1,1,3-tris(2-ethyl-4-hydroxy-5-tert-butylphenyl)butane, 1,1,3-tris(3,5-di-tert-butyl-4-hydroxyphenyl)butane, 1,1,3-tris(2-methyl-4-hydroxy-5-tert-butylphenyl)propane, etc.

(B) Phenol derivatives represented by the general formula (XXI) include 2,2'-methylene-bis(6-tert-butyl-4-methylphenol), 2,2'-methylene-bis(6-tert-butyl-4-ethylphenol), etc.

(C) Phenol derivatives represented by the general formula (XXII) include 4,4'-butylidene-bis(6-tert-butyl-3-methylphenol), 4,4'-thio-bis(3-methyl-6-tert-butylphenol), etc.

(D) Phenol derivatives represented by the general formula (XXIII) include the following:

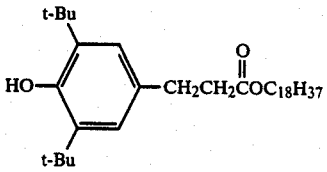

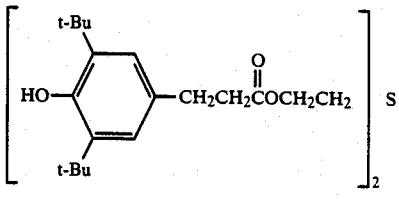

-continued

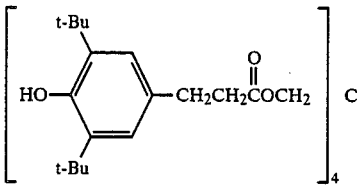

The phenol compounds represented by the foregoing general formulae (XX) to (XXIII) are preferably used in an amount of about 1 to about 200 wt%, more preferably 5 to 50 wt%, based on the electron-accepting compound.

As the support, a paper, a polymeric film, e.g., polyethylene, polyethylene terephthalate, etc. may be used.

Examples of the present invention will be described below, which, however, do not limit the present invention in any way. Unless other wise specified, all parts, percents, ratios and the like are by weight.

EXAMPLES 1 TO 11 AND COMPARATIVE EXAMPLES 1 TO 10

Heat responsibility was measured by copying Test Chart No. 3 made by The Image Electronic Society using a high speed facsimile machine, FF-2000, made by Fujitsu Ltd., and then measuring the density of the copied image using a densitometer, model RD-918, made by Macbeth Co.

Preservability of the heat-sensitive recording material at high temperature and under high humidity was measured by storing uncolored heat-sensitive recording materials and heat-sensitive recording materials having been subjected to the above-described color-forming procedure for 24 hours under the conditions of 70° C. and 30% RH (for testing heat resistance) or 50° C. and 90% RH (for testing humidity resistance), and then measuring fog density of the white background portion and density in the colored portion before and after storage, and the density of the colored sample which was colored after being stored, using a densitometer, model RD-918, made by Macbeth Co.

Additionally, preservability of the colored portion density was calculated as:

$$\frac{\text{Density after storage}}{\text{Density immediately after coloration}} \times 100\ (\%)$$

Compounds of the present invention used in Examples 1 to 11 and Comparative Examples 1 to 10 are shown in Table 1.

Table 2 shows materials used in the heat-sensitive color-forming layer in accordance with the present invention. The electron-donating dye precursors, electron-accepting compounds, and color disappearance-preventing agents were used as dispersions prepared by dispersing 20 g of each of them in a ball mill for one day and one night together with 100 g of a 5% aqueous solution of polyvinyl alcohol (Kuraray PVA-105) to make the volume average particle size not larger than 3 μm. Pigments were used as dispersions prepared by dispersing 80 g of a pigment in a homogenizer together with 160 g of a 0.5% solution of sodium hexametaphosphate. The thus-prepared dispersions were mixed in a proportion of 5 g of the dispersion of electron-donating dye precursor, 10 g of the dispersion of the electron-accepting compound, 2 g of the dispersion of color disappearance-preventing agent, and 22 g of the pigment dispersion, and 3 g of an emulsion containing 21% of zinc stearate and 5 g of a 2% aqueous solution of sodium di(2-ethylhexyl)sulfosuccinate were further added thereto to obtain a mother liquor.

20 g of a compound of the present invention shown in Table 1 was dispersed in a ball mill for one day and one night together with 100 g of a 5% aqueous solution of polyvinyl alcohol (Kuraray PVA-105) to make the volume average particle size not larger than 3 μm, and the resulting dispersion was mixed with the mother liquor in a proportion shown in Table 3 to obtain coating solutions.

Each of the thus-obtained coating solutions was coated on a wood-free paper having a weight distribution of 50 g/m² in a dry coated amount of 7 g/m² using a wire bar, and dried in a 50° C. oven to obtain heat-sensitive recording materials (Examples 1 to 11).

Heat-sensitive color-forming layers were obtained in the same manner as in Examples 1 to 11 except for adding in amounts shown in Table 4 to obtain Comparative Examples 1 to 10.

The results of the tests of Examples 1 to 11 and Comparative Examples 1 to 10 are shown in Table 5.

TABLE 1

| Compounds of the General Formulae (I) to (VI) |
|---|
| 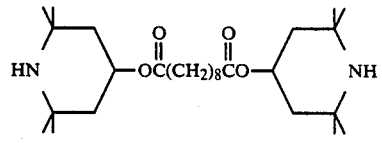 |
| 7 |
| 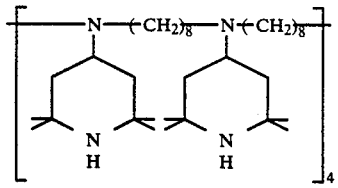 |
| 2 |
| 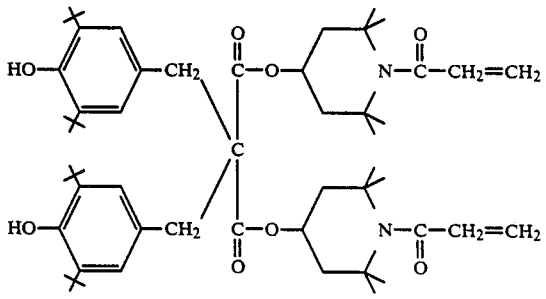 |
| 3 |

TABLE 1-continued

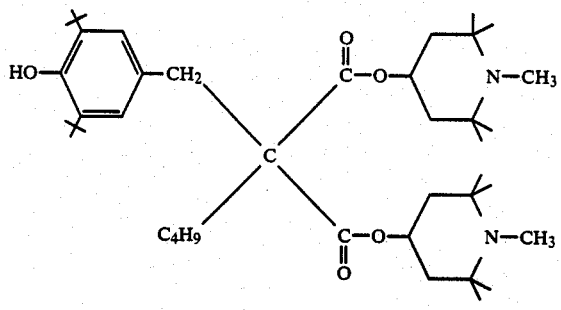

4

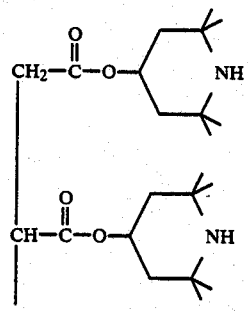

TABLE 1-continued

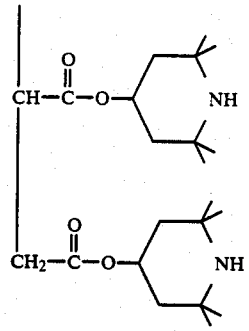

5

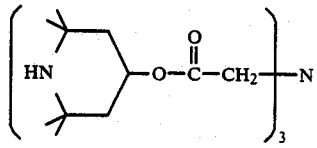

6

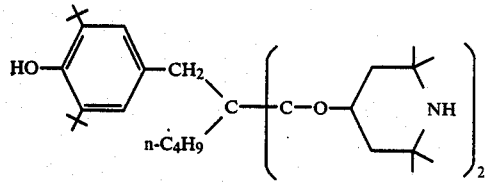

7

| No. | Name of Compounds Represented by the General Formulae (VII) to (XII) |
|---|---|
| a | β-Naphthyl benzyl ether |
| b | Phenyl 1-hydroxy-2-naphthoate |
| c | 1-Phenoxy-2-(4-ethylphenoxy)ethane |
| d | Diethylene glycol bis(4-methoxyphenyl) ether |
| e | N—Stearylurea |

TABLE 2

| Heat-Sensitive Color-Forming Layer | Electron-Donating Dye Precursor | Electron-Accepting Compound | Color Disappearance-Preventing Agent | Pigment |
|---|---|---|---|---|
| A | Crystal Violet lactone | 2,2-Bis(p-hydroxy-phenyl)propane | None | Calcium carbonate |
| B | 2-Anilino-3-chloro-6-diethylaminofluoran | 2,2-Bis(p-hydroxy-phenyl)propane | None | Calcium carbonate |
| C | Mixture (equal weight) of 2-anilino-3-chloro-6-diethylaminofluoran and 2-anilino-3-methyl-6-N—methyl-N—cyclohexylamino-fluoran | Isobutyl bis(4-hydroxy-phenyl)acetate | None | Calcium carbonate |
| D | Mixture (equal weight) of 2-anilino-3-chloro-6-diethylaminofluoran and 2-anilino-3-methyl-6-N—ethyl-N—isoamylamino-fluoran | Mixture (equal amount) of 2,2-bis(p-hydroxy-phenyl)propane and zinc p-pentadecylsalicylate | 1,1,3-Tris(2-methyl-4-hydroxy-5-tert-butyl-phenyl)butane | Mixture (equal amount) of calcium carbonate and amorphous silica |
| E | Mixture (equal weight) of 2-anilino-3-chloro-6-diethylaminofluoran and 2-anilino-3-methyl-6-N—ethyl-N—furylmethylamino-fluoran | 1,1-Bis(4'-hydroxy-phenyl)cyclohexane | 1,1,3-Tris(2-methyl-4-hydroxy-5-tert-butyl-phenyl)butane | Calcined kaolin |
| F | Mixture (equal weight) of 2-anilino-3-chloro-6-diethylaminofluoran and 2-anilino-3-methyl-6-N— | 1,4-Bis(p-hydroxy-cumyl)benzene | 1,1,3-Tris(2-methyl-4-hydroxy-5-tert-butyl-phenyl)butane | Mixture (equal amount) of calcium carbonate and |

TABLE 2-continued

| Heat-Sensitive Color-Forming Layer | Electron-Donating Dye Precursor | Electron-Accepting Compound | Color Disappearance-Preventing Agent | Pigment |
|---|---|---|---|---|
| | ethyl-N—isoamylamino-fluoran | | | zinc oxide |
| G | 2-Anilino-3-methyl-6-N—methyl-N—cyclohexyl-aminofluoran | Benzyl 4-hydroxy-benzoate | 2,2'-Methylene-bis(6-tert-butyl-4-methylphenol) | Aluminum hydroxide |
| H | 2-Anilino-3-methyl-6-N—methyl-N—cyclohexyl-aminofluoran | Benzyl 4-hydroxy-benzoate | 4,4'-Thio-bis(3-methyl-6-tert-butylphenol) | Calcium carbonate |
| I | Mixture (equal weight) of 2-anilino-3-chloro-6-diethylaminofluoran and 2-anilino-3-methyl-6-N—ethyl-N—furylmethylamino-fluoran | Dimethyl 3-hydroxy-o-phthalate | 1,1,3-Tris(2-methyl-4-hydroxy-5-tert-butyl-phenyl)butane | Amorphous silica |
| J | 2-Anilino-3-methyl-6-N—methyl-N—cyclohexylamino-fluoran | Bis[2-(4-hydroxyphenyl-thio)ethoxy]methane | 4,4'-Butylidene-bis(6-tert-butyl-3-methylphenol) | Calcium carbonate |
| K | Mixture (equal weight) of 2-anilino-3-chloro-6-diethylaminofluoran and 2-anilino-3-methyl-6-N—methyl-N—cyclohexylamino-fluoran | 1,1-Bis(4'-hydroxy-phenyl)cyclohexane | 1,1,3-Tris(2-methyl-4-hydroxy-5-tert-butyl-phenyl)butane | Calcium carbonate |

TABLE 3

| Example No. | Symbol for Heat-Sensitive Color-Forming Layer | Combination of the Compounds of the Present Invention and Amount Added (g) | | | |
|---|---|---|---|---|---|
| | | Formulae (I) to (VI) | | Formulae (VII) to (XII) | |
| 1 | A | 1 | 1.0 | e | 10.0 |
| 2 | B | 2 | 3.5 | a | 10.0 |
| 3 | C | 3 | 2.0 | b | 8.0 |
| 4 | D | 3 | 2.5 | c | 7.5 |
| 5 | E | 4 | 2.0 | d | 8.0 |
| 6 | F | 4 | 1.5 | a | 5.0 |
| 7 | G | 5 | 0.5 | a | 12.0 |
| 8 | H | 6 | 1.0 | b | 5.0 |
| 9 | I | 7 | 2.0 | c | 8.0 |
| 10 | J | 3 | 2.5 | d | 8.0 |
| 11 | K | 4 | 1.8 | a | 7.5 |

TABLE 4

| Comparative Example No. | Symbol for Heat-Sensitive Color-Forming Layer | Combination of the Compounds of the Present Invention and Amount Added (g) | | | |
|---|---|---|---|---|---|
| | | Formulae (I) to (VI) | | Formulae (VII) to (XII) | |
| 1 | A | None | — | e | 10.0 |
| 2 | B | None | — | a | 10.0 |
| 3 | C | 3 | 2.0 | None | — |
| 4 | D | 3 | 2.5 | None | — |
| 5 | E | 4 | 5.0 | d | 8.0 |
| 6 | F | 4 | 8.0 | a | 5.0 |
| 7 | G | 5 | 0.02 | a | 12.0 |
| 8 | H | 6 | 1.0 | b | 1.0 |
| 9 | I | 7 | 2.0 | c | 0.02 |
| 10 | J | None | — | None | — |

TABLE 5

| Example No. | Evaluation Results | | | | | | | |
|---|---|---|---|---|---|---|---|---|
| | Heat Responsi-bility (density) | Color Density after Heat Resistance Test | Color Density after Humidity Resistance Test | Background Fog Density | Background Fog Density after Heat Resistance Test | Background Fog Density after Humidity Resistance Test | Preserva-bility after Heat Resistance Test (%) | Preserva-bility after Humidity Resistance Test (%) |
| Ex. | | | | | | | | |
| 1 | 1.22 | 1.21 | 1.22 | 0.05 | 0.12 | 0.09 | 89 | 88 |
| 2 | 1.35 | 1.33 | 1.34 | 0.05 | 0.11 | 0.09 | 90 | 91 |
| 3 | 1.32 | 1.30 | 1.32 | 0.06 | 0.13 | 0.10 | 90 | 92 |
| 4 | 1.30 | 1.30 | 1.29 | 0.06 | 0.10 | 0.08 | 101 | 99 |
| 5 | 1.36 | 1.35 | 1.35 | 0.05 | 0.09 | 0.10 | 100 | 99 |
| 6 | 1.35 | 1.36 | 1.35 | 0.05 | 0.10 | 0.10 | 101 | 99 |
| 7 | 1.36 | 1.34 | 1.34 | 0.05 | 0.11 | 0.08 | 96 | 98 |
| 8 | 1.35 | 1.34 | 1.35 | 0.05 | 0.13 | 0.08 | 99 | 97 |
| 9 | 1.30 | 1.28 | 1.28 | 0.04 | 0.14 | 0.09 | 98 | 99 |
| 10 | 1.35 | 1.33 | 1.34 | 0.05 | 0.11 | 0.08 | 101 | 99 |
| 11 | 1.30 | 1.28 | 1.29 | 0.05 | 0.09 | 0.09 | 99 | 97 |
| Comp. Ex. | | | | | | | | |
| 1 | 1.25 | 1.23 | 1.22 | 0.08 | 0.26 | 0.20 | 76 | 82 |
| 2 | 1.30 | 1.28 | 1.25 | 0.07 | 0.28 | 0.23 | 89 | 78 |
| 3 | 1.10 | 0.98 | 1.00 | 0.08 | 0.19 | 0.19 | 73 | 78 |
| 4 | 1.05 | 0.95 | 0.93 | 0.08 | 0.18 | 0.15 | 81 | 83 |
| 5 | 1.10 | 0.68 | 0.72 | 0.08 | 0.09 | 0.09 | 67 | 73 |
| 6 | 1.05 | 0.77 | 0.78 | 0.08 | 0.10 | 0.11 | 72 | 82 |
| 7 | 1.15 | 1.00 | 0.99 | 0.08 | 0.33 | 0.28 | 99 | 100 |
| 8 | 1.02 | 0.91 | 0.93 | 0.09 | 0.22 | 0.20 | 100 | 98 |

TABLE 5-continued

| Example No. | Evaluation Results: Heat Responsibility (density) | Color Density after Heat Resistance Test | Color Density after Humidity Resistance Test | Background Fog Density | Background Fog Density after Heat Resistance Test | Background Fog Density after Humidity Resistance Test | Preservability after Heat Resistance Test (%) | Preservability after Humidity Resistance Test (%) |
|---|---|---|---|---|---|---|---|---|
| 9 | 1.00 | 0.86 | 0.87 | 0.08 | 0.20 | 0.18 | 67 | 82 |
| 10 | 1.00 | 0.89 | 0.91 | 0.08 | 0.10 | 0.10 | 80 | 81 |

EXAMPLES 12 TO 22 AND COMPARATIVE EXAMPLES 11 TO 33

Further, examples of heat-sensitive recording materials were prepared as described above (using the recording layer compositions L to V shown in Table 7 below) but incorporating compounds represented by the general formula (XIII) as shown in Table 6.

TABLE 6

| Compounds of the General Formula (XIII) | | | | | | | | |
|---|---|---|---|---|---|---|---|---|
| No. | X | $R_1$ | $R_2$ | $R_3$ | $R_4$ | $R_5$ | $R_6$ | n |
| 1. | $-C_4H_8-$ | H | t-Octyl group | H | H | H | H | 5 |

TABLE 6-continued

| Compounds of the General Formula (XIII) | | | | | | | | |
|---|---|---|---|---|---|---|---|---|
| No. | X | $R_1$ | $R_2$ | $R_3$ | $R_4$ | $R_5$ | $R_6$ | n |
| 2. | $-C_4H_8-$ | H | t-Amyl | H | H | H | H | 5 |
| 3. | $-C_2H_4OC_2H_4-$ | H | t-Octyl | H | H | H | H | 6 |
| 4. | $-C_6H_{12}-$ | H | t-Octyl | H | H | H | H | 5 |
| 5. | $-C_8H_{16}-$ | 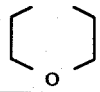 | | H | H | H | H | 5 |

Note: Symbols in the top of Table 6 mean symbols in the general formula (XIII) described above in this specification.

TABLE 7

| Heat-Sensitive Color-Forming Layer | Electron-Donating Dye Precursor | Electron-Accepting Compound | Compounds of Formulae (VII) to (XII) | Color Disappearance Preventing Agent | Pigment |
|---|---|---|---|---|---|
| L | Crystal Violet lactone | 2,2-Bis(p-hydroxyphenyl)propane | Stearic acid amide | None | Calcium carbonate |
| M | 2-Anilino-3-chloro-6-diethylaminofluoran | 2,2-Bis(p-hydroxyphenyl)propane | Stearic acid amide | None | Calcium carbonate |
| N | Mixture (equal weight) of 2-anilino-3-chloro-6-diethylaminofluoran and 2-anilino-3-methyl-6-N—methyl-N—cyclohexylamino-fluoran | 2,2-Bis(p-hydroxyphenyl)propane | β-Naphthyl benzyl ether | None | Calcium carbonate |
| O | Mixture (equal weight) of 2-anilino-3-chloro-6-eithylaminofluoran and 2-anilino-3-methyl-6-N—ethyl-N—isoamylamino-fluoran | Mixture (equal amount) of 2,2-bis-(p-hydroxyphenyl)-propane and zinc p-pentadecylsalicylate | Phenyl 1-hydroxy-2-naphthoate | 1,1,3-Tris(2-methyl-4-hydroxy-5-tert-butyl-phenyl)-butane | Mixture (equal amount) of calcium carbonate and amorphous silica |
| P | Mixture (equal weight) of 2-anilino-3-chloro-6-diethylaminofluoran and 2-anilino-3-methyl-6-N—ethyl-N—furylmethylamino-fluoran | 1,1-Bis(4'-hydroxyphenyl)cyclohexane | 1-Phenoxy-2-(4-ethyl-phenoxy)-ethane | 1,1,3-Tris(2-methyl-4-hydroxy-5-tert-butyl-phenyl)-butane | Calcined kaolin |
| Q | Mixture (equal weight) of 2-anilino-3-chloro-6-diethylaminofluoran and 2-anilino-3-methyl-6-N—ethyl-N—isoamylamino-fluoran | 1,4-Bis(p-hydroxycumyl)benzene | β-Naphthyl benzyl ether | 1,1,3-Tris-(2-methyl-4-hydroxy-5-t-butylphenyl)-butane | Mixture (equal amount) of calcium carbonate and zinc oxide |
| R | 2-Anilino-3-methyl-6-N—methyl-N—cyclohexyl-aminofluoran | Benzyl 4-hydroxybenzoate | None | 2,2'-methylene-bis(6-tert-butyl-4-methylphenol) | Aluminum oxide |
| S | 2-Anilino-3-methyl-6-N—methyl-N—cyclohexyl-aminofluoran | Benzyl 4-hydroxybenzoate | Phenyl 1-hydroxy-2-naphthoate | 4,4'-Thio-bis(3-methyl-6-tert-butyl-phenol) | Calcium carbonate |
| T | Mixture (equal weight) of 2-anilino-3-chloro-6-diethylaminofluoran and 2-anilino-3-methyl-6-N—ethyl-N—furylmethylamino-fluoran | Dimethyl 3-hydroxy-o-phthalate | Diethylene glycol-bis-(4-methoxy-phenyl) ether | 1,1,3-Tris-(2-methyl-4-hydroxy-5-t-butylphenyl)-butane | Amorphous silica |
| U | 2-Anilino-3-methyl-6-N—methyl-N—cyclohexyl- | Bis[2-(4-hydroxyphenylthio)ethoxy]- | 1-Phenoxy-2-(4-ethoxy- | 4,4'-butylidene-bis(6- | Calcium carbonate |

TABLE 7-continued

| Heat-Sensitive Color-Forming Layer | Electron-Donating Dye Precursor | Electron-Accepting Compound | Compounds of Formulae (VII) to (XII) | Color Disappearance Preventing Agent | Pigment |
|---|---|---|---|---|---|
| | aminofluoran | methane | phenoxy)-ethane | tert-butyl-3-methylphenol) | |
| V | Mixture (equal weight) of 2-anilino-3-chloro-6-diethylaminofluoran and 2-anilino-3-methyl-6-N—methyl-N—cyclohexyl-aminofluoran | 1,1-Bis(4'-hydroxy-phenyl)cyclohexane | β-Naphthyl benzyl ether | 1,1,3-Tris-(2-methyl-4-hydroxy-5-tert-butyl-phenyl)butane | Calcium carbonate |

Table 7 shows materials used in the heat-sensitive color-forming layers in accordance with the present invention. The electron-donating dye precursors, electron-accepting compounds, compounds of the formulae (VII) to (XII), and color disappearance-preventing agents were used as dispersions prepared by dispersing 20 g of each of them in a ball mill for one day and one night together with 100 g of a 5% aqueous solution of polyvinyl alcohol (Kuraray PVA-105) to make the volume average particle size not larger than 3 μm. Pigments were used as dispersions prepared by dispersing 80 g of a pigment in a homogenizer together with 160 g of a 0.5% solution of sodium hexametaphosphate. The thus-prepared dispersions were mixed in a proportion of 5 g of the dispersion of electron-donating dye precursor, 10 g of the dispersion of electron-accepting compound, 5 g of the dispersion of compounds of the formula (VII) to (XII), 2 g of the dispersion of color disappearance-preventing agent, and 22 g of the pigment dispersion. Further, 3 g of an emulsion containing 21% of zinc stearate and 5 g of a 2% aqueous solution of sodium di(2-ethylhexyl)sulfosuccinate were added thereto to obtain a motor liquor.

20 g of a compound of the formula (XIII) of the present invention shown in Table 6 was dispersed in a ball mill for one day and one night together with 100 g of a 5% aqueous solution of polyvinyl alcohol (Kuraray PVA-105) to make the volume average particle size not larger than 3 μm, and the resulting dispersion was mixed with the mother liquor in a proportion shown in Table 8 to obtain coating solutions.

Each of the thus-obtained coating solutions was coated on a wood-free paper having a weight distribution of 50 g/m$^2$ in a dry coated amount of 7 g/m$^2$ using a wire bar, and dried in a 50° C. oven to obtain heat-sensitive recording materials (Examples 12 to 22).

Heat-sensitive color-forming layers were formed in the same manner as described respectively as to Examples 12 to 22 above except for not adding the compounds of the general formula (XIII) of the present invention to form Comparative Examples 11 to 21.

Heat-sensitive color-forming layers were formed in the same manner as described respectively as to Examples 12 to 22 above except for adding the compounds represented by the general formula (XIII) of the present invention in proportions described in Table 9 to obtain Comparative Examples 22 to 33.

The results of testing the samples obtained in Examples 12 to 22 and Comparative Examples 11 to 33 are tabulated in Table 10.

TABLE 8

| Example No. | Heat-Sensitive Color-Forming Layer (Table 7) | Compound No. (Table 6) | Added Amount (g) |
|---|---|---|---|
| 12 | L | 1 | 1.8 |
| 13 | M | 2 | 0.1 |
| 14 | N | 2 | 1.8 |
| 15 | O | 3 | 0.1 |
| 16 | P | 3 | 1.5 |
| 17 | Q | 4 | 0.1 |
| 18 | R | 4 | 0.8 |
| 19 | S | 4 | 1.5 |
| 20 | T | 4 | 1.8 |
| 21 | U | 5 | 0.5 |
| 22 | V | 5 | 1.8 |

TABLE 9

| Comparative Example No. | Amount of Compound of the Formula (XIII) of the Present Invention Added |
|---|---|
| 22 | 2.5 g |
| 23 | 3.0 g |
| 24 | 2.7 g |
| 25 | 10.0 g |
| 26 | 5.0 g |
| 27 | 8.0 g |
| 28 | 2.5 g |
| 29 | 2.3 g |
| 30 | 2.2 g |
| 31 | 2.5 g |
| 32 | 10.0 g |
| 33 | 2.5 g |

TABLE 10

| | Evaluation Results | | | | | | | |
|---|---|---|---|---|---|---|---|---|
| Example No. | Heat-Responsibility (density) | Color Density after Heat Resistance Test | Color Density after Humidity Resistance Test | Background Fog Density | Background Fog Density after Heat Resistance Test | Background Fog Density after Humidity Resistance Test | Preservability after Heat Resistance Test (%) | Preservability after Humidity Resistance Test (%) |
| Ex. | | | | | | | | |
| 12 | 1.12 | 1.11 | 1.12 | 0.05 | 0.12 | 0.09 | 91 | 92 |
| 13 | 1.18 | 1.15 | 1.18 | 0.05 | 0.11 | 0.10 | 91 | 93 |
| 14 | 1.30 | 1.28 | 1.31 | 0.06 | 0.13 | 0.09 | 90 | 92 |

TABLE 10-continued

| Example No. | Evaluation Results: Heat-Responsibility (density) | Color Density after Heat Resistance Test | Color Density after Humidity Resistance Test | Background Fog Density | Background Fog Density after Heat Resistance Test | Background Fog Density after Humidity Resistance Test | Preservability after Heat Resistance Test (%) | Preservability after Humidity Resistance Test (%) |
|---|---|---|---|---|---|---|---|---|
| 15 | 1.25 | 1.24 | 1.26 | 0.06 | 0.10 | 0.08 | 101 | 99 |
| 16 | 1.25 | 1.23 | 1.25 | 0.05 | 0.09 | 0.09 | 100 | 99 |
| 17 | 1.30 | 1.28 | 1.29 | 0.05 | 0.10 | 0.10 | 101 | 99 |
| 18 | 1.32 | 1.33 | 1.32 | 0.05 | 0.11 | 0.09 | 96 | 98 |
| 19 | 1.35 | 1.34 | 1.35 | 0.05 | 0.13 | 0.09 | 99 | 97 |
| 20 | 1.28 | 1.25 | 1.28 | 0.04 | 0.14 | 0.08 | 98 | 99 |
| 21 | 1.25 | 1.23 | 1.24 | 0.05 | 0.11 | 0.09 | 101 | 99 |
| 22 | 1.30 | 1.28 | 1.29 | 0.05 | 0.09 | 0.08 | 99 | 97 |
| Comp. Ex. | | | | | | | | |
| 11 | 1.13 | 1.12 | 1.12 | 0.08 | 0.26 | 0.20 | 92 | 93 |
| 12 | 1.19 | 1.18 | 1.19 | 0.07 | 0.28 | 0.23 | 91 | 92 |
| 13 | 1.30 | 1.25 | 1.28 | 0.08 | 0.23 | 0.19 | 91 | 94 |
| 14 | 1.24 | 1.19 | 1.23 | 0.08 | 0.19 | 0.15 | 99 | 98 |
| 15 | 1.25 | 1.25 | 1.26 | 0.08 | 0.20 | 0.18 | 98 | 97 |
| 16 | 1.30 | 1.31 | 1.29 | 0.08 | 0.22 | 0.16 | 98 | 99 |
| 17 | 1.33 | 1.32 | 1.33 | 0.08 | 0.23 | 0.18 | 99 | 100 |
| 18 | 1.36 | 1.28 | 1.36 | 0.09 | 0.20 | 0.13 | 100 | 98 |
| 19 | 1.36 | 1.29 | 1.37 | 0.08 | 0.29 | 0.15 | 98 | 99 |
| 20 | 1.25 | 1.24 | 1.23 | 0.08 | 0.19 | 0.18 | 96 | 98 |
| 21 | 1.30 | 1.29 | 1.30 | 0.08 | 0.22 | 0.20 | 99 | 97 |
| 22 | 1.05 | 0.85 | 0.77 | 0.05 | 0.09 | 0.08 | 68 | 80 |
| 23 | 1.08 | 0.74 | 0.85 | 0.05 | 0.08 | 0.05 | 75 | 89 |
| 24 | 1.20 | 0.66 | 0.78 | 0.05 | 0.08 | 0.06 | 69 | 82 |
| 25 | 1.15 | 0.92 | 0.96 | 0.05 | 0.06 | 0.07 | 83 | 85 |
| 26 | 1.15 | 0.88 | 0.89 | 0.05 | 0.07 | 0.08 | 88 | 90 |
| 27 | 1.20 | 0.98 | 1.00 | 0.04 | 0.08 | 0.07 | 83 | 91 |
| 28 | 1.22 | 0.86 | 0.98 | 0.05 | 0.09 | 0.08 | 81 | 86 |
| 29 | 1.25 | 0.99 | 1.02 | 0.05 | 0.11 | 0.09 | 83 | 90 |
| 30 | 1.15 | 0.65 | 0.87 | 0.06 | 0.08 | 0.08 | 75 | 83 |
| 31 | 1.23 | 0.74 | 0.83 | 0.05 | 0.09 | 0.08 | 88 | 89 |
| 32 | 1.18 | 0.88 | 0.95 | 0.05 | 0.08 | 0.08 | 78 | 86 |
| 33 | 1.25 | 0.95 | 0.98 | 0.05 | 0.09 | 0.08 | 89 | 92 |

The results of testing shown in Tables 5 and 10 above clearly demonstrate the unexpectedly remarkable results that both the first embodiment (Examples 1 to 11, employing both compounds of the formulae (I) to (VI) and (VII) to (XII)) and the second type of embodiment (Examples 12 to 22, employing compounds of the formula (XIII)) of heat-sensitive recording materials according to the present invention are able to obtain with respect to heat responsibility, color density of recorded images (after both heat resistance and humidity resistance tests), preservation qualities, and the prevention of fog formation in the background area (even after the recorded images were subjected to heat and humidity resistance tests). In contrast, Comparative Examples 1 to 33, which either lacked compounds according to the present invention, or contained such compounds in amounts less than required per the present invention, failed to achieve the surprising level of superior results obtained by Examples 1 to 22 of the present invention.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having provided thereon a heat-sensitive color-forming layer which contains a colorless or slightly colored electron-donating dye precursor and an electron-accepting compound capable of reacting with said electron-donating dye precursor to form color, wherein said heat-sensitive color-forming layer further contains about 0.5 wt% to less than about 20 wt%, based on said electron-accepting compound, of the compound represented by the following general formula (XIII):

(XIII)

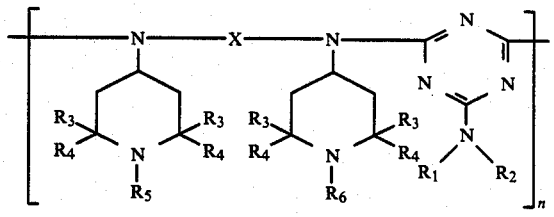

wherein $R_1$ and $R_2$ each may represent a hydrogen atom, an alkyl group, an aryl group or $R_1$ and $R_2$ may combine to form a 5- to 7-membered ring optionally containing a hetero atom or atoms, X represents an alkylene group, an aralkylene group, an alkenylene group or an arylene group, $R_3$ and $R_4$ each may represent a hydrogen atom or an alkyl group, $R_5$ and $R_6$ each may represent a hydrogen atom, an alkyl group or an acyl group, and n represents an integer.

2. A heat-sensitive recording material as claimed in claim 1, wherein said compounds represented by the general formula (XIII) are present in an amount of from 1 wt% to less than 18 wt% based on said electron-accepting compound.

3. A heat-sensitive recording material as claimed in claim 1, wherein said electron-donating dye precursor is selected from the group consisting of triarylmethane compounds, diphenylmethane compounds, xanthene compounds, thiazine compounds, and spiropyran compounds.

4. A heat-sensitive recording material as claimed in claim 1, wherein said electron-accepting compounds are represented by the following general formulae (XV) to (XIX):

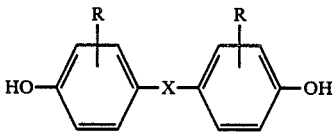

(XV)

wherein X represents S, O, $SO_2$, $S_2$ or

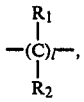

l represents an integer of 1 to 3, $R_1$ and $R_2$ each may represent a hydrogen atom or an alkyl group containing 1 to 8 carbon atoms or $R_1$ and $R_2$ may combine to form a cycloalkyl group, or $R_2$ may represent an ester group represented by —COOR', wherein R' represents an alkyl group containing 1 to 10 carbon atoms, and R represents a straight or branched chain alkyl group containing 1 to 8 carbon atoms or a halogen atom;

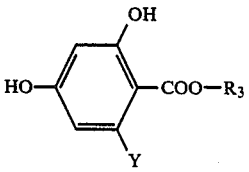

(XVI)

wherein Y represents a hydrogen atom, $—CH_3$ or —OH, and $R_3$ represents

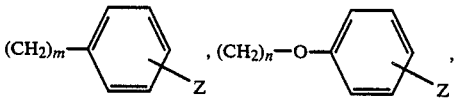

or a straight or branched chain alkyl group containing 1 to 6 carbon atoms, m and n each represents an integer of 1 to 3, wherein Z represents a hydrogen atom, a halogen atom or $—CH_3$;

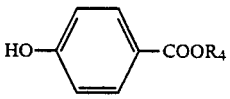

(XVII)

wherein $R_4$ represents a benzyl group, a halogen atom or a straight or branched chain alkyl group containing 1 to 8 carbon atoms;

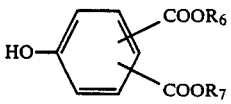

(XVIII)

wherein $R_6$ and $R_7$ each may represent an alkyl group containing 1 to 8 carbon atoms; and

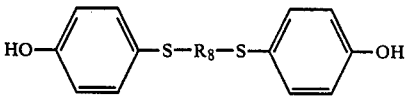

(XIX)

wherein $R_8$ represents an alkylene group containing 1 to 5 ether bonds.

5. A heat-sensitive recording material as claimed in claim 1, wherein said electron-accepting compounds are present in an amount of about 50 to about 800 wt% based on said electron-donating dye precursor.

6. A heat-sensitive recording material as claimed in claim 1, wherein said electron-accepting compounds are present in an amount of 100 to 500 wt% based on said electron-donating dye precursor.

7. A heat-sensitive recording material as claimed in claim 1, wherein said color-forming layer further contains compounds represented by the general formulae (VII) to (XII) as defined in claim 1 above, and wherein said compounds are present in an amount of about 10 to about 200 wt% based on the electron-accepting compound.

8. A heat-sensitive recording material as claimed in claim 7, wherein said compounds are present in an amount of 20 to 150 wt% based on the electron-accepting compound.

* * * * *